US007286123B2

(12) United States Patent
Yang

(10) Patent No.: US 7,286,123 B2
(45) Date of Patent: Oct. 23, 2007

(54) LED DRIVER CIRCUIT HAVING TEMPERATURE COMPENSATION

(75) Inventor: Ta-yung Yang, Milpitas, CA (US)

(73) Assignee: System General Corp., Taipei Hsien (TW)

( * ) Notice: Subject to any disclaimer, the term of this patent is extended or adjusted under 35 U.S.C. 154(b) by 0 days.

(21) Appl. No.: 11/302,734

(22) Filed: Dec. 13, 2005

(65) Prior Publication Data

US 2007/0132692 A1 Jun. 14, 2007

(51) Int. Cl.
*G09G 5/00* (2006.01)

(52) U.S. Cl. ..... 345/204; 345/212; 345/214; 345/82; 345/84; 315/309; 315/307; 315/291; 315/312

(58) Field of Classification Search ..... 315/309, 315/308, 297, 307, 291, 312, 324; 345/204, 345/212, 214, 82, 83, 84
See application file for complete search history.

(56) References Cited

U.S. PATENT DOCUMENTS

| | | | | |
|---|---|---|---|---|
| 6,239,716 | B1 * | 5/2001 | Pross et al. | 340/815.4 |
| 6,841,947 | B2 * | 1/2005 | Berg-johansen | 315/169.3 |
| 2006/0022916 | A1 * | 2/2006 | Aiello | 345/82 |
| 2006/0043911 | A1 * | 3/2006 | Shao et al. | 315/291 |

* cited by examiner

*Primary Examiner*—Tuyet Vo
(74) *Attorney, Agent, or Firm*—J.C. Patents

(57) ABSTRACT

A LED driver circuit is provided for controlling the brightness of a LED. A control circuit is used for generating a LED current in accordance with a resistor. The control circuit is further coupled to detect a LED voltage for adjusting the LED current in reference to the LED voltage. The value of the LED voltage is correlated to the LED temperature. Therefore, the LED current is then programmed in accordance with the LED temperature.

15 Claims, 5 Drawing Sheets

LED DRIVER CIRCUIT HAVING TEMPERATURE COMPENSATION

BACKGROUND OF THE INVENTION

Field of Invention

The present invention relates to a LED (light-emitting diode) driver, and more particularly to a control circuit for controlling the LED driver.

The LED driver is utilized to control the brightness of the LED in accordance with its temperature characteristics. The LED driver is utilized to control the current that flows through the LED. A higher current increases the intensity of the brightness, but decreases the lifespan of the LED. FIG. 1 shows a circuit of a traditional LED driver. The voltage source 10 is adjusted to provide a current $I_{LED}$ through a resistor 15 to a plurality of LEDs 20~25. The current $I_{LED}$ can be shown as the following:

$$I_{LED} = \frac{V - V_{F20} - V_{F21} - \ldots - V_{F25}}{R_{15}} \quad (1)$$

wherein the $V_{F20}$~$V_{F25}$ are a plurality of forward voltages of the LEDs 20~25, respectively. The drawback of the traditional LED driver shown in FIG. 1 is the variability of the current $I_{LED}$. The current $I_{LED}$ is varied in response to the change of the forward voltages $V_{F20}$~$V_{F25}$. The forward voltages $V_{F20}$~$V_{F25}$ are not constant due to the variations in production and operating temperatures.

FIG. 2 shows another approach for the traditional LED driver. A current source 35 is connected in series with the LEDs 20~25 for providing a constant current to the LEDs 20~25. However, the disadvantage of the aforementioned circuit is that the chromaticity and the luminosity of the LED are changed in response to the variation in the LED temperature. To keep the chromaticity and/or the luminosity of LED are constant, the LED current should be adjusted in response to the temperature changes. The objective of the present invention is to develop a LED driver having temperature compensation.

SUMMARY OF THE INVENTION

The present invention provides a LED driver circuit for controlling the brightness of the LED. The LED driver circuit includes a control circuit for generating a LED current for the control of the LED. A first resistor is connected to the control circuit for determining the value of the LED current. A control terminal of the control circuit is coupled to receive a control signal for determining the duty cycle of the LED current. A sense terminal of the control circuit is coupled to the LED for detecting a LED voltage. The LED voltage is utilized for adjusting the LED current. A second resistor connected to the control circuit determines a slope of the adjustment, in which the slope represents the change of the LED current versus the change of the LED voltage. The value of the LED voltage is correlated to the LED temperature. Therefore the LED current can be programmed to compensate for the variations in chromaticity and the luminosity in accordance with the LED temperature.

BRIEF DESCRIPTION OF THE DRAWINGS

The accompanying drawings are included to provide a further understanding of the present invention, and are incorporated in and constitute a part of this specification. The drawings illustrate embodiments of the present invention and, together with the description, serve to explain the principles of the present invention.

DESCRIPTION OF THE EMBODIMENTS

Figure 1:
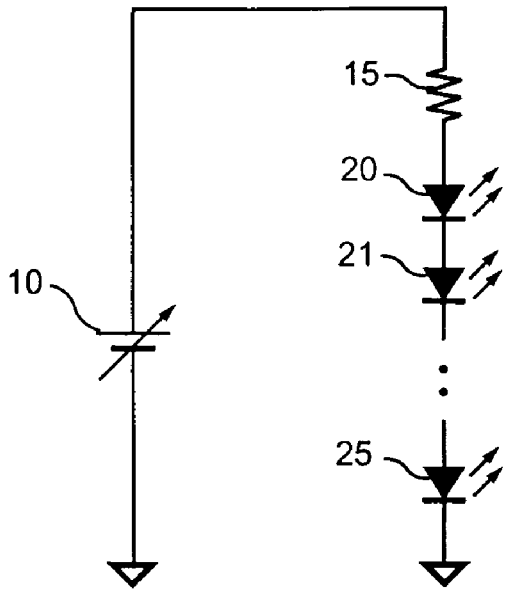
FIG. 1 (Prior Art)
FIG. 1 shows a traditional LED driver.
Figure 2:
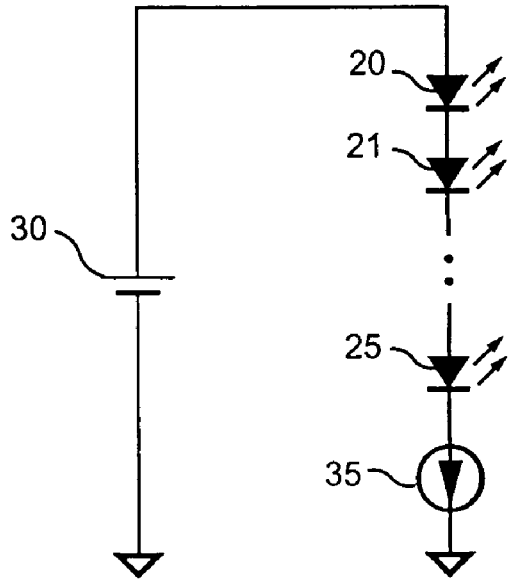
FIG. 2 (Prior Art)
FIG. 2 shows another traditional LED driver.
Figure 3:
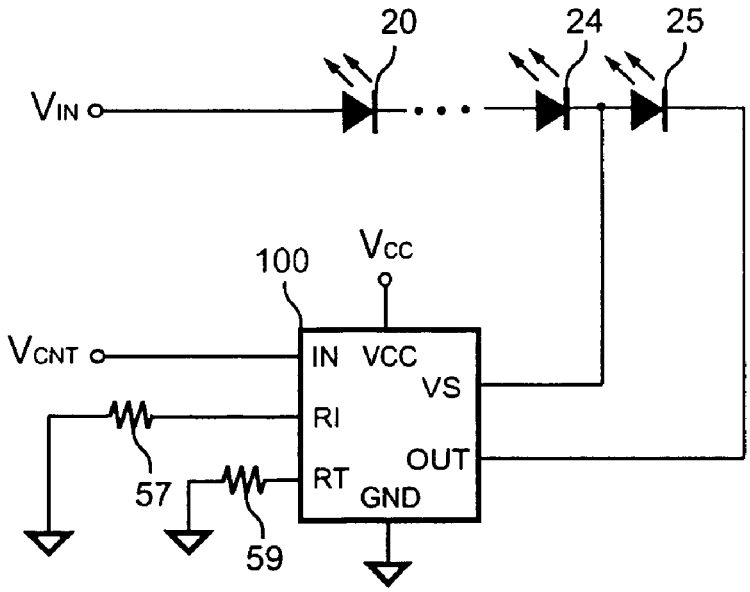
FIG. 3 shows an embodiment of the LED driver circuit in accordance with the present invention.
Figure 4:
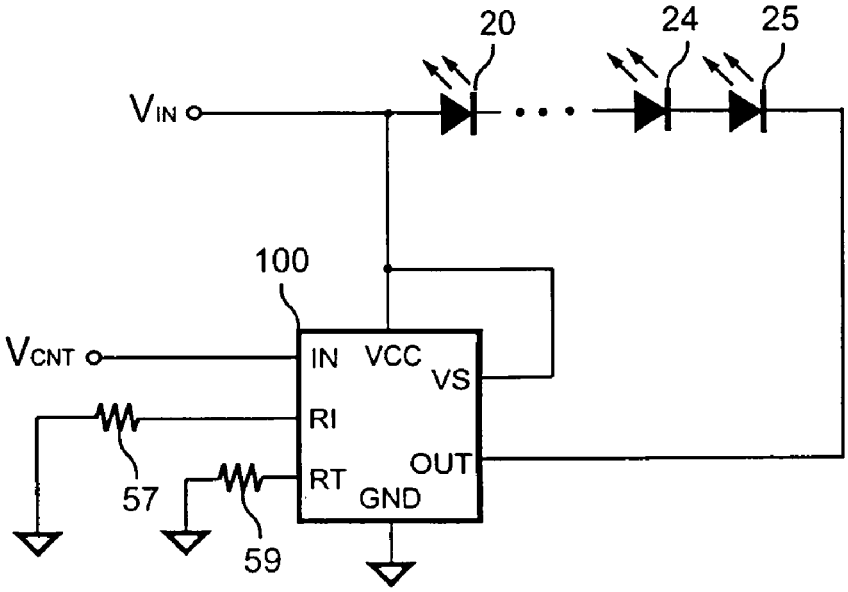
FIG. 4 shows another embodiment of the LED driver circuit in accordance with the present invention.

FIGS. 3 and 4 show a plurality of embodiments of a LED driver circuit in accordance with present invention, in which the LEDs 20~25 are connected in series. A voltage source $V_{IN}$ is supplied to the LEDs 20~25. A control circuit 100 is coupled with the LEDs 20~25. FIG. 3 shows that the power of the control circuit 100 is supplied by a voltage source $V_{CC}$. FIG. 4 shows that the power of the control circuit 100 is directly supplied from the voltage source $V_{IN}$. The control circuit 100 is utilized for generating a LED current at an output terminal OUT of the control circuit 100 for controlling the LEDs 20~25. A first resistor 57 is connected to the control circuit 100 for determining the value of the LED current. A control terminal IN of the control circuit 100 is coupled for receiving a control signal $V_{CNT}$ to turn the LED current on/off and to determine the duty cycle of the LED current. A sense terminal VS of the control circuit 100 is connected to the LEDs 20~25 for detecting a LED voltage. The LED voltage is further coupled for adjusting the LED current. A second resistor 59 is connected to the control circuit 100 for determining the slope of the adjustment. The slope represents the change of the LED current versus the change of the LED voltage. The value of the LED voltage is correlated to the LED temperature. Therefore, the LED current can be programmed to compensate the chromaticity and the luminosity variations in accordance with the LED temperature variations. To detect the LED temperature, the LED current includes a first LED current $I_1$ and a second LED current $I_2$. The second LED current $I_2$ is correlated to the first LED current $I_1$. The LED voltage includes a first LED forward voltage $V_1$ and a second LED forward voltage $V_2$. The first LED forward voltage $V_1$ and the second LED forward voltage $V_2$ are produced in response to the first LED current $I_1$ and the second LED current $I_2$, respectively.

Figure 5:
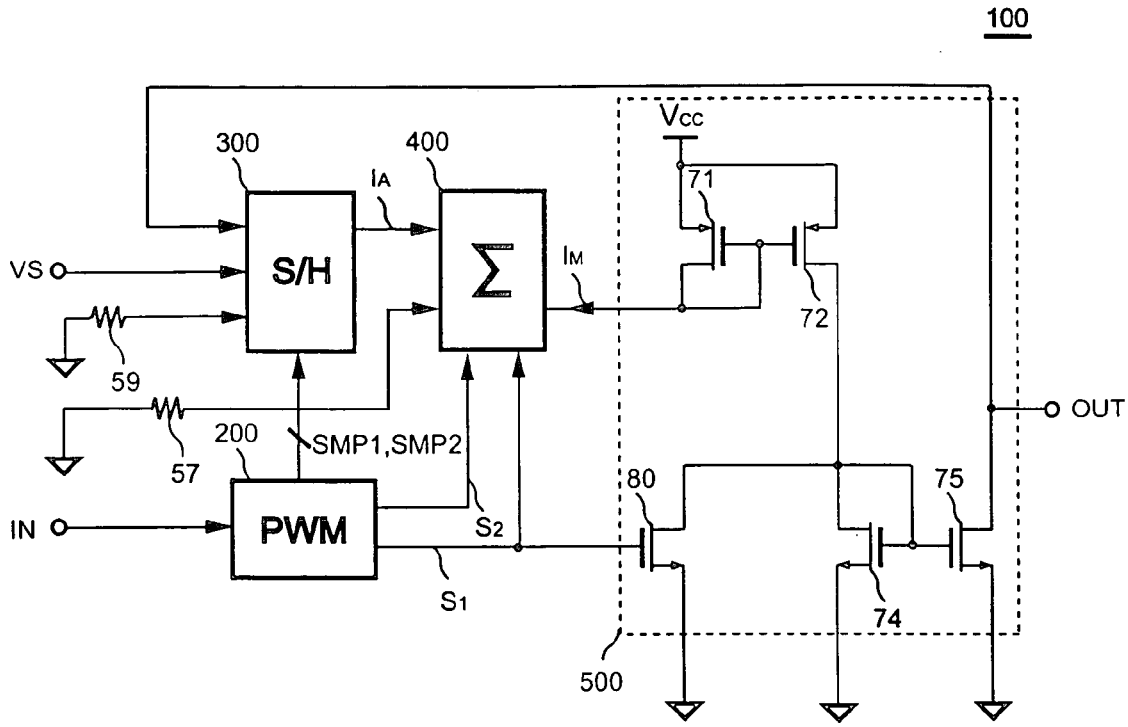
FIG. 5 shows a control circuit of the LED driver circuit in accordance with the present invention.

FIG. 5 shows the schematic block of the control circuit 100 of the present invention. A PWM circuit 200 is coupled to the control terminal IN to generate a first control signal $S_1$ for controlling the duty cycle of the LED current. A sample circuit 300 is coupled to the sense terminal VS and the second resistor 59 through the terminal RT for generating an adjust signal $I_A$ in response to the LED voltage and the resistance of the second resistor 59. A modulation circuit 400 is coupled to the PWM circuit 200, the sample circuit 300, and the first resistor 57 through the terminal RI for generating a modulation signal $I_M$ in reference to the resistance of the first resistor 57 and to the adjust signal $I_A$. A plurality of transistors 71, 72, 74, 75, and 80 develop a first current mirror circuit 500 for generating the LED current at the output terminal OUT in accordance with the first control signal $S_1$ and the modulation signal $I_M$. The LED current is turned off in response to the disabling of the first control signal $S_1$.

Figure 6:
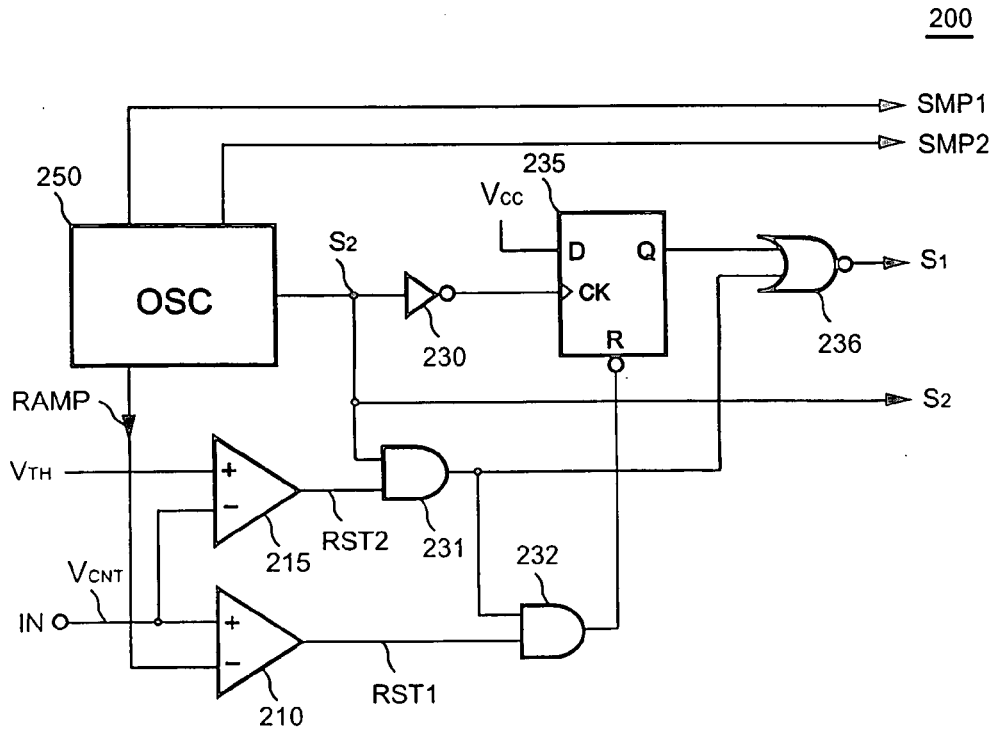
FIG. 6 shows a PWM circuit of the control circuit for controlling the duty cycle and the brightness of the LED in accordance with the present invention.

FIG. 6 shows the circuit schematic of the PWM circuit 200. The PWM circuit includes an oscillator 250 for generating a ramp signal RAMP, a second control signal S2, a first pulse signal SMP1, and a second pulse signal SMP2. A first reset signal RST1 is generated by a first comparator 210 once the control signal $V_{CNT}$ is lower than the ramp signal RAMP. A second reset signal RST2 is generated by a second comparator 215 once the control signal $V_{CNT}$ is lower than a threshold signal $V_{TH}$. A flip-flop 235, a NOR gate 236, an inverter 230, and a plurality of AND gates 231, 232 develop a latch circuit, which is coupled to the second control signal $S_2$, the first reset signal RST1 and the second reset signal RST2. The flip-flop 235 is clocked on by the second control signal $S_2$ through the inverter 230. The second control signal $S_2$ is further connected to the input of the AND gate 231. Another input of the AND gate 231 is connected to the output of the second comparator 215. The output of the AND gate 231 is connected to the input of the NOR gate 236 and the input of the AND gate 232. Another input of the AND gate 232 is connected to the output of the first comparator 210. The output of the AND gate 232 is applied to reset the flip-flop 235. The output of the flip-flop 235 is connected to another input of the NOR gate 236 for generating the first control signal $S_1$ at the output of the NOR gate 236. The first control signal $S_1$ is thus generated by the latch circuit in response to the second control signal $S_2$. The first control signal $S_1$ is enabled in response to the second control signal $S_2$, and the first control signal $S_1$ is disabled in response to the first reset signal RST1 and/or the second reset signal RST2. The first pulse signal SMP1 and the second pulse signal SMP2 are generated in response to the falling edge and the rising edge of the second control signal $S_2$.

Figure 7:
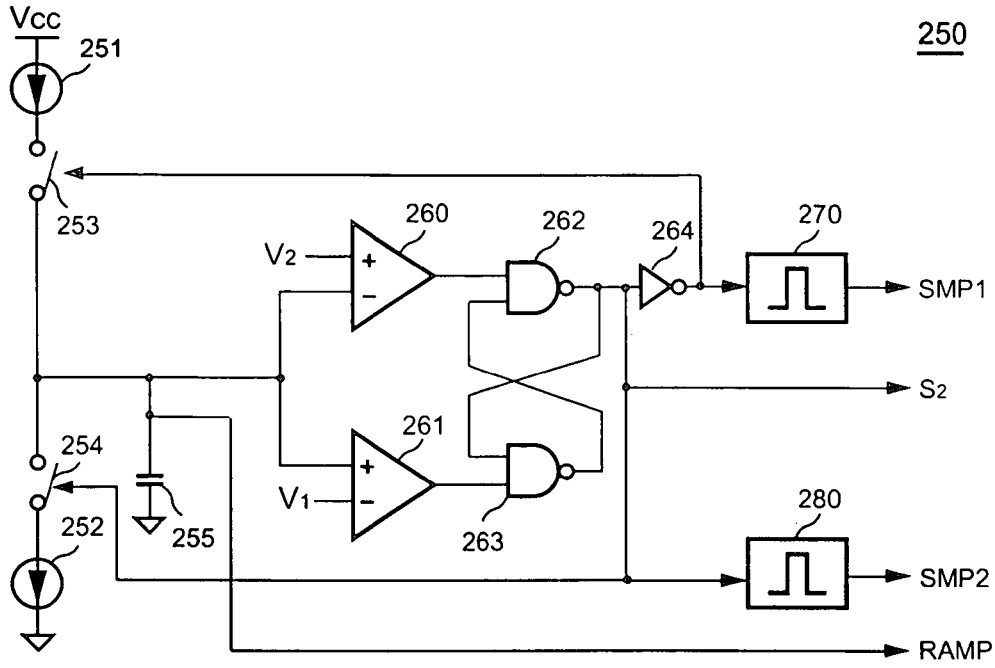
FIG. 7 shows an oscillator of the PWM circuit in accordance with the present invention.

FIG. 7 shows the circuit of the oscillator 250 of the PWM circuit 200 in accordance with the present invention. A current source 251 is connected to a capacitor 255 through a switch 253 for charging the capacitor 255. A current source 252 is connected to the capacitor 255 via a switch 254 for discharging the capacitor 255. A comparator 261 having a first trip-point voltage $V_1$ is connected to the capacitor 255 for generating a charge signal once the voltage on capacitor 255 is lower than the first trip-point voltage $V_1$. A comparator 260 having a second trip-point voltage $V_2$ is connected to the capacitor 255 for generating a discharge signal once the voltage of the capacitor 255 is higher than the second trip-point voltage $V_2$. A plurality of NAND gates 262 and 263 form a RS-latch connected to the charge signal and the discharge signal, respectively. The second control signal $S_2$ is thus produced by the output of the NAND gate 262. Through an inverter 264, the second control signal $S_2$ is connected to a pulse generator 270 for producing the first pulse signal SMP1. The second control signal $S_2$ is coupled to a pulse generator 280 for producing the second pulse signal SMP2. The second control signal $S_2$ and the output of the inverter 264 are connected for controlling the switches 254 and 253, respectively. The ramp signal RAMP is generated at the capacitor 255.

Figure 8:
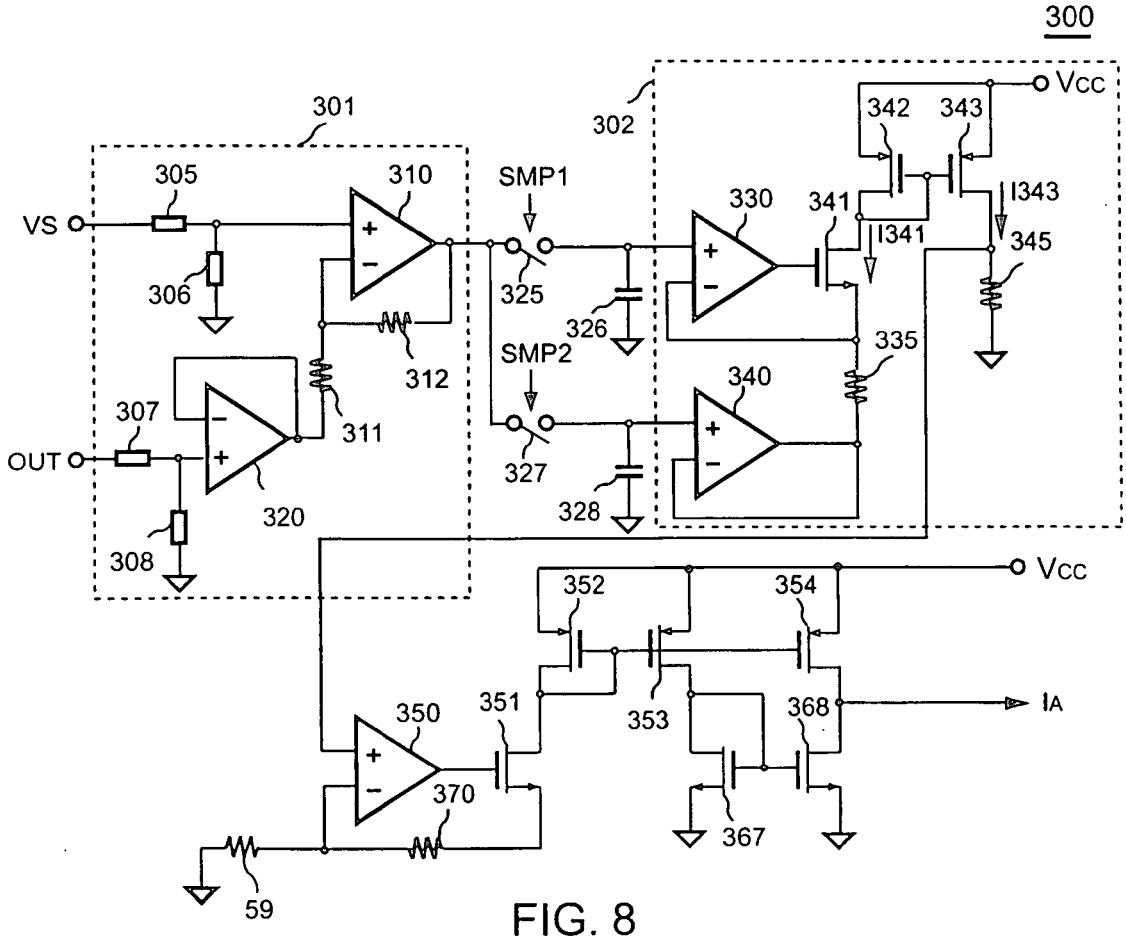
FIG. 8 shows a sample circuit of the control circuit in accordance with the present invention.

FIG. 8 shows the sample circuit 300, in which a plurality of operational amplifiers 310, 320 and a plurality of resistors 305, 306, 307, 308, 311, 312 develop a first differential circuit 301. The resistors 305 and 306 form a voltage divider connected from the sense terminal $V_S$ to the input of the operational amplifier 310 for detecting the LED voltage. The resistors 307 and 308 form another voltage divider connected from the output terminal OUT to the input of the operational amplifier 320. The operational amplifier 320 is connected for operating as a buffer. The operational amplifier 310 connected to the resistors 311 and 312 for operating as a differential amplifier. The operational amplifier 310 therefore outputs the differential value of signals on the sense terminal $V_S$ and the output terminal OUT. The aforementioned differential value represents the LED voltage. A switch 325 and a capacitor 326 form a first sample circuit. A switch 327 and a capacitor 328 form a second sample circuit. A plurality of switches 325 and 327 are controlled by the first pulse signal SMP1 and the second pulse signal SMP2, respectively. The output of the operational amplifier 310 is connected to the first sample circuit and the second sample circuit. Therefore, the first sample circuit is utilized to sample the first LED forward voltage $V_1$ of the LED voltage in response to the first pulse signal SMP1. The second sample circuit is applied to sample the second LED forward voltage $V_2$ of the LED voltage in response to the second pulse signal SMP2. A plurality of operational amplifiers 330, 340, transistors 341, 342, 343, and resistors 335, 345 develop a second differential circuit 302, coupled to the first sample circuit and the second sample circuit, for generating a differential signal in accordance with the differential value of the first LED forward voltage $V_1$ and the second LED forward voltage $V_2$. The capacitor 328 and switch 327 is connected to the input of the operational amplifier 340. The operational amplifier 340 is connected as a buffer. The capacitor 326 and switch 325 is coupled to the input of the operational amplifier 330. The operational amplifiers 330, 340, the resistor 335, and the transistor 341 produce a current I341. The transistors 342 and 343 form a first current mirror connected to the current I341 for generating a current I343. The current I343 and the resistor 345 produce the differential signal. An operational amplifier 350 and a plurality of transistors 351, 352, 353, 354, 367, 368 develop a voltage-to-current converter. The input of the operational amplifier 350 is connected to the differential signal. Another input of the operational amplifier 350 is coupled to the resistor 59 through the terminal RI. Therefore, the voltage-to-current converter generates the adjust signal $I_A$ in accordance with the differential signal and the resistance of the resistor 59. A resistor 370 is connected from the transistor 351 to the second resistor 59 through the terminal RI for protecting the voltage-to-current converter against the short circuit of the second resistor 59 through the terminal RI.

Figure 9:
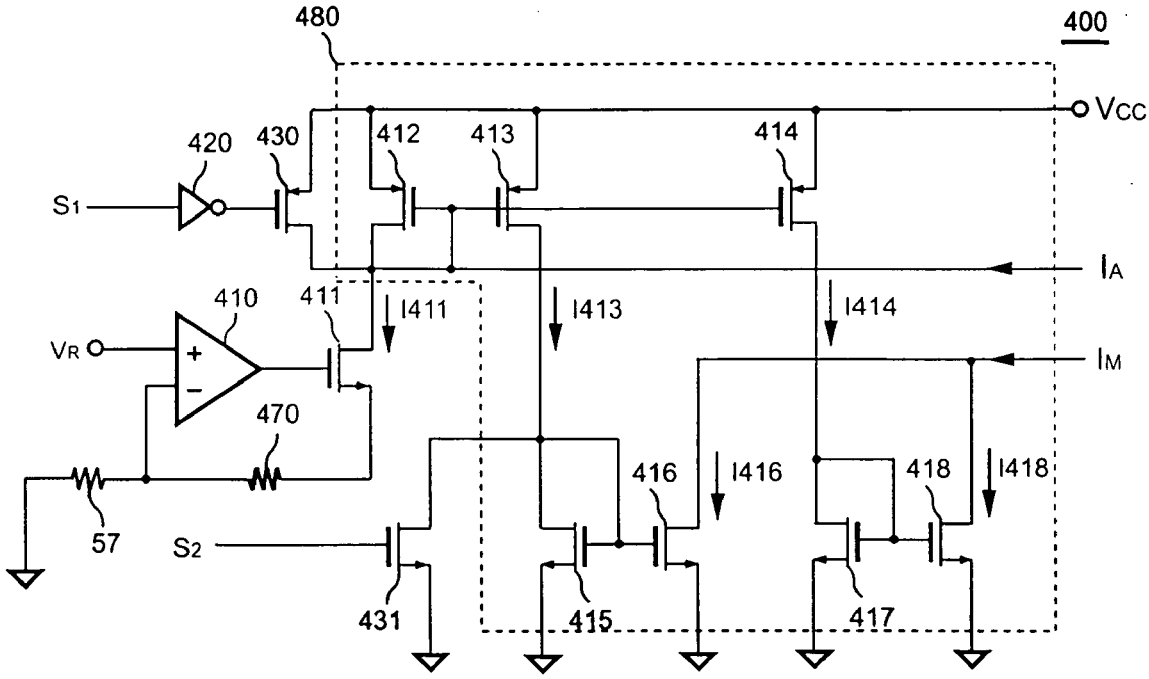
FIG. 9 shows a modulation circuit of the control circuit in accordance with the present invention.

FIG. 9 shows the modulation circuit 400 of the control circuit 100 in accordance with the present invention. A current generator is developed from an operational amplifier 410 and a transistor 411. A reference voltage $V_R$ is connected to the input of the operational amplifier 410. Another input of the operational amplifier 410 is connected to the first resistor 57 through the terminal RI for producing a reference current I411 in accordance with the reference voltage $V_R$ and the resistance of the resistor 57. A resistor 470 is connected from the transistor 411 to the first resistor 57 for protecting the current generator against the short circuit of the resistor 57. A plurality of transistors 412~418 form a second current mirror circuit 480 for generating the modulation signal $I_M$ in accordance with the reference current I411 and the adjust signal $I_A$. The transistors 412, 413 and 414 form a second current mirror for producing a currents I413 and I414 in reference to the reference current I411 and the adjust signal $I_A$. The transistors 415 and 416 form a third current mirror for producing a current I416 in reference to the current I413. The transistors 417 and 418 form a fourth current mirror for generating a current I418 in reference to the current I414. The modulation signal $I_M$ is produced in accordance with the currents I416 and I418. The first control signal $S_1$ is connected to a transistor 430 via an inverter 420. The transistor 430 is further coupled to the second current mirror for disabling the currents I413 and I414 in response to the first control signal $S_1$. A transistor 431 is coupled to the third current mirror for disabling the current I416 in response to the second control signal $S_2$. Therefore, the modulation signal $I_M$ is enabled in response to the enabling of the first control signal $S_1$ to generate the first LED current $I_1$. The modulation signal $I_M$ is farther controlled to generate the second LED current $I_2$ in response to the second control signal $S_2$.

Figure 10:
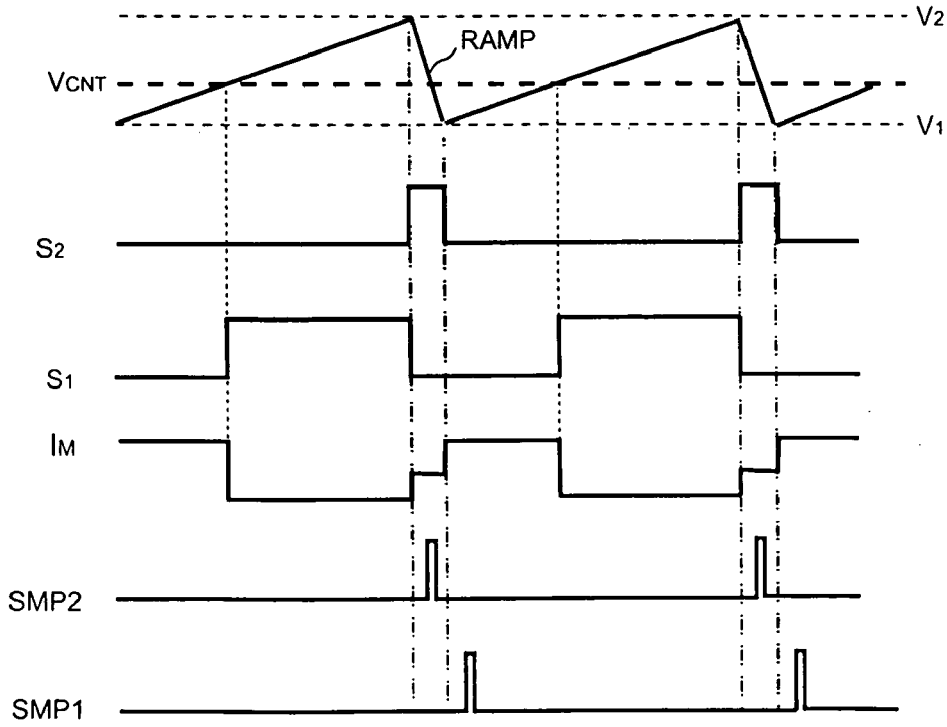
FIG. 10 shows a plurality of waveforms of the control circuit in accordance with the present invention.

FIG. 10 shows the waveform of the first control signal $S_1$ that is generated by comparing the control signal $V_{CNT}$ with the ramp signal RAMP during the rising period of the ramp signal RAMP. The second control signal $S_2$ is generated during the falling period of the ramp signal RAMP. The modulation signal $I_M$ is disabled in response to the disabling of the first control signal $S_1$ (logic-high). The modulation signal $I_M$ is controlled to generate the first LED current $I_1$ in response to the enabling of the first control signal $S_1$ (logic-low), and the second LED current $I_2$ is generated in response to the enabling of the second control signal $S_2$ (logic-high). The first pulse signal SMP1 is generated to sample the first LED forward voltage $V_1$ during the period of the first LED current $I_1$. The second pulse signal SMP2 is generated to sample the second LED forward voltage $V_2$ during the period of the second LED current $I_2$. The first LED forward voltage $V_1$ is defined; and the second LED forward voltage $V_2$ is measured in response to the first LED current $I_1$ and the second LED current $I_2$, in which the current $I_1$ and $I_2$ can be given by the following:

$$I_1 = I_{0\times e}{}^{V1/VT} \tag{5}$$

$$I_2 = I_{0\times e}{}^{V2/VT} \tag{6}$$

$$VT = \frac{k \times Temp}{q} \tag{7}$$

where k is the Boltzmann's constant, q is the charge on an electron, and $T_{emp}$ is the absolute temperature.

$$Temp = \frac{q}{k} \times \frac{V_1 - V_2}{\ln\left(\frac{I_1}{I_2}\right)} \tag{8}$$

The aforementioned equations show that the LED temperature can be accurately detected from the LED voltage. The LED temperature is further used for programming the LED current to compensate the chromaticity and the luminosity of the LED.

While the present invention has been particularly shown and described with reference to the embodiments thereof, it will be understood by those of ordinary skill in the art that various changes in form and details may be made therein without departing from the spirit and scope of the present invention as defined by the appended claims.

What is claimed is:

1. A LED driver circuit, comprising:

a control circuit, generating a LED current for controlling the LED;

a first resistor, connected to the control circuit for determining the value of the LED current;

a control terminal of the control circuit, coupled to receive a control signal for determining the duty cycle of the LED current;

a sense terminal of the control circuit, coupled to the LED for detecting a LED voltage, wherein the LED voltage is coupled to adjust the LED current; and a second resistor, connected to the control circuit for determining a slope of the adjustment, in which the slope represents the change of the LED current versus the change of the LED voltage.

2. The LED driver circuit as claimed in claim 1, wherein the LED current comprises a first LED current and a second LED current; the second LED current is correlated to the first LED current; the LED voltage comprises a first forward voltage and a second forward voltage, wherein the first forward voltage and the second forward voltage are produced in response to the first LED current and the second LED current, respectively.

3. The LED driver circuit as claimed in claim 1, the control circuit comprising:

a PWM circuit, coupled to the control terminal for generating a first control signal for controlling the duty cycle of the LED current;

a sample circuit, coupled to the sense terminal and the second resistor for generating an adjust signal in response to the LED voltage and the resistance of the second resistor;

a modulation circuit, coupled to the first resistor, the PWM circuit, and the sample circuit for generating a modulation signal in reference to the resistance of the first resistor and the adjust signal; and a first current mirror circuit, coupled to the PWM circuit and the modulation circuit for generating the LED current in accordance with the first control signal and the modulation signal.

4. The LED driver circuit as claimed in claim 3, the PWM circuit comprising:

an oscillator, generating a ramp signal, a second control signal, a first pulse signal, and a second pulse signal;

a first comparator, generating a first reset signal once the control signal is lower than the ramp signal;

a second comparator, generating a second reset signal once the control signal is lower than a threshold signal; and a latch circuit, coupled to the second control signal for generating the first control signal in response to the second control signal, wherein the first control signal is enabled in response to the second control signal, the first control signal is disabled in response to the first reset signal and the second reset signal, and the first pulse signal and the second pulse signal are generated in response to the falling edge and the rising edge of the second control signal, respectively.

5. The LED driver circuit as claimed in claim 4, wherein the first control signal is disabled in response to a first reset signal or a second reset signal.

6. The LED driver circuit as claimed in claim 3, the sample circuit comprising:

a first differential circuit, coupled to the sense terminal for detecting the LED voltage;

a first sample circuit, sampling the first forward voltage of the LED voltage in response to the first pulse signal;

a second sample circuit, sampling the second forward voltage of the LED voltage in response to the second pulse signal;

a second differential circuit, generating a differential signal in accordance with the differential value of the first forward voltage and the second forward voltage; and a voltage-to-current converter, coupled to the second resistor for generating the adjust signal in accordance with the differential signal and the resistance of the second resistor.

7. The LED driver circuit as claimed in claim 3, the modulation circuit comprising:

a current generator, generating a reference current in accordance with a reference voltage and the resistance of the first resistor; and a second current mirror circuit, generating the modulation signal in accordance with the reference current and the adjust signal, wherein the modulation signal is enabled in response to the enabling of the first control signal for generating the first LED current, and the modulation signal is controlled for generating the second LED current in response to the second control signal.

8. A LED controller, comprising:

a control circuit, generating a LED current for controlling the LED;

a control terminal of the control circuit, coupled for receiving a control signal for determining the LED current; and a sense terminal of the control circuit, coupled to the LED for detecting a LED voltage, wherein the LED voltage is coupled for adjusting the LED current.

9. The LED controller as claimed in claim 8, further comprising:

a first resistor, coupled to the control circuit for determining the value of the LED current; and a second resistor, coupled to the control circuit for determining a slope of the adjustment, in which the slope represents the change of the LED current versus the change of the LED voltage.

10. The LED circuit controller as claimed in claim 8, wherein the LED current comprises a first LED current and a second LED current, the second LED current is correlated to the first LED current, and the LED voltage comprises a first forward voltage and a second forward voltage, wherein the first forward voltage and the second forward voltage are produced in response to the first LED current and the second LED current, respectively.

11. The LED controller as claimed in claim 8, the control circuit comprising:

a PWM circuit, coupled to the control terminal for generating a first control signal for controlling the duty cycle of the LED current;

a sample circuit, coupled to the sense terminal for generating an adjust signal in response to the LED voltage;

a modulation circuit, coupled to the PWM circuit and the sample circuit for generating a modulation signal in reference to the adjust signal; and a first current mirror circuit, coupled to the PWM circuit and the modulation circuit for generating the LED current in accordance with the first control signal and the modulation signal.

12. The LED controller as claimed in claim 11, the PWM circuit comprising:

an oscillator, generating a ramp signal, a second control signal, a first pulse signal, and a second pulse signal;

a first comparator, generating a first reset signal once the control signal is lower than the ramp signal;

a second comparator, generating a second reset signal once the control signal is lower than a threshold signal; and a latch circuit, coupled to the second control signal for generating the first control signal in response to the second control signal, wherein the first control signal is enabled in response to the second control signal, the first control signal is disabled in response to the first reset signal and the second reset signal, and the first pulse signal and the second pulse signal generating in response to the falling edge and the rising edge of the second control signal respectively.

13. The LED controller as claimed in claim 12, wherein the first control signal is disabled in response to a first reset signal or a second reset signal.

14. The LED controller as claimed in claim 11, the sample circuit comprising:

a first differential circuit, coupled to the sense terminal for detecting the LED voltage;

a first sample circuit, sampling the first forward voltage of the LED voltage in response to the first pulse signal;

a second sample circuit, sampling the second forward voltage of the LED voltage in response to the second pulse signal;

a second differential circuit, generating a differential signal in accordance with the differential value of the first forward voltage and the second forward voltage; and a voltage-to-current converter, generating the adjust signal in accordance with the differential signal.

15. The LED controller as claimed in claim 11, the modulation circuit comprising:

a current generator, generating a reference current in accordance with a reference voltage; and a second current mirror circuit, generating the modulation signal in accordance with the reference current and the adjust signal, wherein the modulation signal is enabled in response to the enabling of the first control signal for generating the first LED current, and the modulation signal is controlled for generating the second LED current in response to the second control signal.

* * * * *